US011473523B2

(12) United States Patent
Klosterberg et al.

(10) Patent No.: US 11,473,523 B2
(45) Date of Patent: Oct. 18, 2022

(54) CYLINDER CRANKCASE INCLUDING A FOREIGN OBJECT INCLUSION FOR CAST REDUCTION AND FOR IMPROVED CLEANLINESS OF THE COMPONENT

(71) Applicant: DEUTZ Aktiengesellschaft, Cologne (DE)

(72) Inventors: Johannes Klosterberg, Swisttal (DE); Marco Sliwa, Siegburg (DE)

(73) Assignee: Deutz Aktiengesellschaft, Cologne (DE)

( * ) Notice: Subject to any disclaimer, the term of this patent is extended or adjusted under 35 U.S.C. 154(b) by 0 days.

(21) Appl. No.: 17/377,411

(22) Filed: Jul. 16, 2021

(65) Prior Publication Data

US 2022/0025831 A1 Jan. 27, 2022

(30) Foreign Application Priority Data

Jul. 22, 2020 (DE) ..... 10 2020 004 388.7

(51) Int. Cl.
*F02F 7/00* (2006.01)
*F02F 1/10* (2006.01)
(Continued)

(52) U.S. Cl.
CPC ..... *F02F 7/0095* (2013.01); *B22C 9/103* (2013.01); *B22C 9/108* (2013.01); *F02F 1/16* (2013.01); *F02F 7/0021* (2013.01)

(58) Field of Classification Search
CPC ..... F02F 7/0085; F02F 7/0095; F02F 1/102; F02F 7/0021; F02F 7/0053; F02F 2007/0063; F02F 2200/06
See application file for complete search history.

(56) References Cited

U.S. PATENT DOCUMENTS 2,018,612 A * 10/1935 Good ..... F02F 7/0007 123/41.83
3,290,740 A * 12/1966 Matthews ..... F02F 7/0053 164/113

(Continued)

FOREIGN PATENT DOCUMENTS

DE 102006043421 A1 10/2007
EP 1039118 A2 9/2000

(Continued)

*Primary Examiner* — Long T Tran

(74) *Attorney, Agent, or Firm* — Davidson, Davidson & Kappel, LLC

(57) ABSTRACT

A method is for generating a cylinder crankcase including a foreign object inclusion for cast reduction and for the improved cleanliness of the generated component. The cast material is in particular removed or pushed from the areas between the tie-rods (2) below the water jacket (1), to avoid dirt input into the component during later engine operation. The areas below the water jacket (1) between the tie-rods (2) are designed as a separate tie-rod core (3), and the bolts (4) used during later installation at the water jacket core (5) are enclosed in the tie-rod core (3), so that the tie-rod core (3) is completely surrounded by cast material in the component following the cast and the bolt (4) has coalesced with the cast, and the tie-rod core (3) remains in the generated component and is located in an encapsulated space generated by the cast material.

10 Claims, 3 Drawing Sheets

(51) Int. Cl.
*B22C 9/10* (2006.01)
*F02F 1/16* (2006.01)

(56) References Cited

U.S. PATENT DOCUMENTS

| | | | | | |
|---|---|---|---|---|---|
| 4,869,217 | A * | 9/1989 | Kastlunger | F02B 75/16 | 475/904 |
| 5,083,537 | A * | 1/1992 | Onofrio | F02F 7/0085 | 123/41.74 |
| 5,178,202 | A * | 1/1993 | Dannoura | F02F 1/108 | 164/112 |
| 6,286,210 | B1 | 9/2001 | Rueckert et al. | | |
| 6,729,292 | B1 * | 5/2004 | Bock | F01M 11/08 | 184/106 |
| 8,176,967 | B2 | 5/2012 | Henkel et al. | | |
| 9,803,583 | B2 * | 10/2017 | Azevedo | F02F 1/102 | |
| 2011/0174246 | A1 * | 7/2011 | Graf | B22C 9/105 | 164/94 |
| 2020/0164428 | A1 * | 5/2020 | Bachmayer | B22D 15/02 | |

FOREIGN PATENT DOCUMENTS

| | | | |
|---|---|---|---|
| EP | 1060047 | B1 | 9/2002 |
| GB | 2541014 | | 2/2017 |
| WO | WO2008011863 | A1 | 1/2008 |

* cited by examiner

CYLINDER CRANKCASE INCLUDING A FOREIGN OBJECT INCLUSION FOR CAST REDUCTION AND FOR IMPROVED CLEANLINESS OF THE COMPONENT

This claims priority of German Patent Application DE 10 2020 004 388.7, filed Jul. 22, 2020 and hereby incorporated-by-reference herein.

BACKGROUND

A method for manufacturing a cast component including a cast pipe is known from WO 002008011863 A1.

Further, EP 1060047 B1 describes a method for manufacturing a blank of a cylinder liner to be cast into a light-metal crankcase of a lifting crank machine.

For the development of cylinder crankcases, a lot of emphasis is put on the weight and the cleanliness of the component. Present-day constructions often display cast accumulations in the area between the tie-rods of the main bearing screw connection below the water jacket of the cylinder crankcase. Alternatively, present-day constructions have a glasses core to remove the material from the above-mentioned areas. Constructions including a glasses core have the disadvantage that the areas formed by the glasses core are very delicate. A great deal of cleaning effort is necessary to properly clean these areas. Dirt input from these areas cannot be excluded during later engine operation.

SUMMARY

An object of the present disclosure is to prevent the disadvantages mentioned above and to create a method that prevents dirt input during later engine operation, in particular.

A method is provided for generating a cylinder crankcase including a foreign object inclusion for cast reduction and for the improved cleanliness of the generated component, the cast material being in particular removed or pushed from the areas between the tie-rod below the water jacket, to avoid dirt input into the component during later engine operation, the areas below the water jacket between the tie-rods being designed as a separate tie-rod core, and the bolts used during later installation at the water jacket core being enclosed by the tie-rod core, so that the tie-rod core, following the cast, is completely surrounded by cast material in the component and the bolt has coalesced with the cast, the tie-rod core remaining in the generated component and being located in an encapsulated space generated by the cast material.

BRIEF SUMMARY OF THE DRAWINGS

The drawings illustrate one exemplary embodiment of the present disclosure.

DETAILED DESCRIPTION

Figure 1:
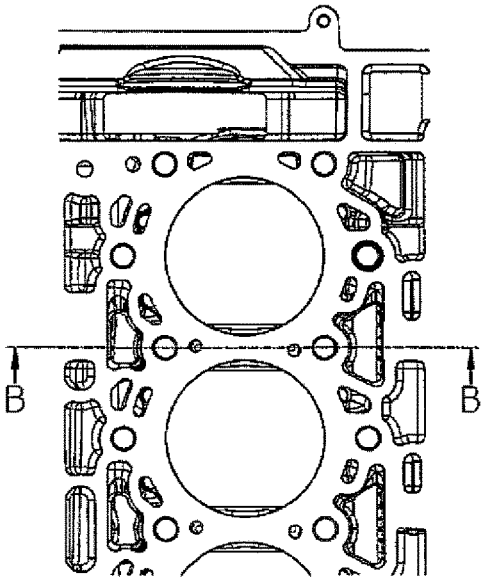
FIG. 1 shows a section from the cylinder crankcase.

In FIG. 1, a section from the cylinder crankcase of an internal combustion engine, in particular a diesel internal combustion engine, is illustrated.

Figure 2:
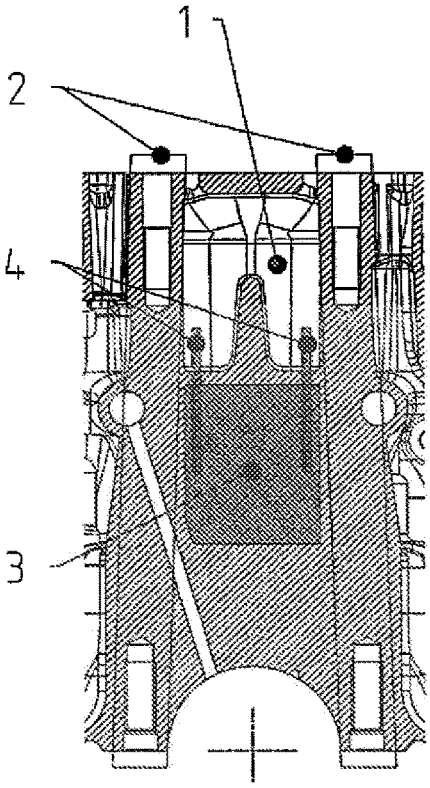
FIG. 2 shows a section B-B from FIG. 1.

FIG. 2 shows a section along line B-B of the internal combustion engine from FIG. 1. Water jacket 1 between tie-rods 2 is separated by the cast material of the cylinder crankcase of the internal combustion engine from tie-rod core 3. Bolts 4 enclosed by tie-rod core 3 are also surrounded by the cast material of the cylinder crankcase of the internal combustion engine as is tie-rod core 3, so that no contamination of core material may take place during later engine operation.

Figure 3:
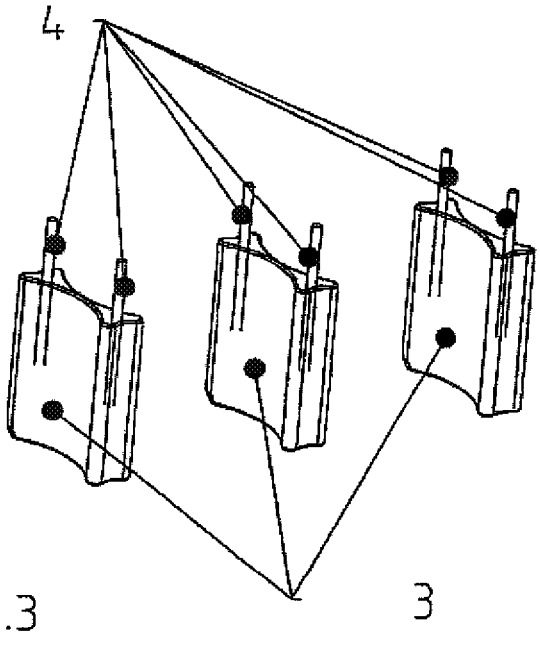
FIG. 3 shows the bolts enclosed by the tie-rod core.

FIG. 3 shows bolts 4 enclosed by tie-rod core 3.

Figure 4:
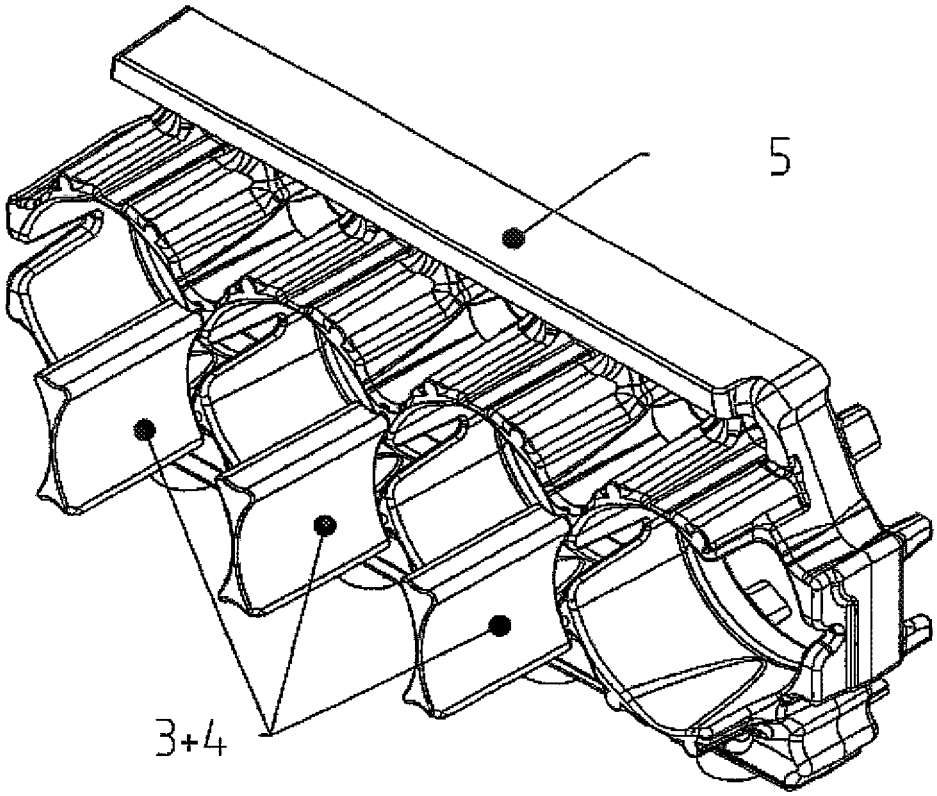
FIG. 4 shows the water jacket core and the tie-rod cores from FIG. 3 to be installed.

FIG. 4 illustrates water jacket core 5 and tie-rod cores 3 from FIG. 3 to be installed.

The present disclosure represents an approach in that the cast material is removed or pushed from the areas between the tie-rods 2 from FIG. 2 below water jacket 1 from FIG. 2 and does not cause dirt input into the component during later engine operation. The areas below water jacket 1 from FIG. 2 between tie-rods 2 from FIG. 2 are generated as separate tie-rod core 3 from FIG. 2. In tie-rod cores 3 from FIG. 3, bolts 4 are enclosed, as is shown in FIG. 3, which are used for later installation at water jacket core 5 from FIG. 4. The tie-rods 2 penetrate the water jacket 1 in the upper area and form a pip-like area between the threads of the bearing cover screw and the cylinder head screw. Water jacket core 5 therefore forms the shaping element for the upper part of the tie-rod. Tie-rod core 3 from FIG. 2 is completely surrounded by cast material in the component following the cast; bolt 4 from FIG. 2 has coalesced with the cast. Tie-rod core 3 from FIG. 2 remains within the component and is located in an encapsulated space and thus does not require cleaning. Dirt input into the component is not possible. With the aid of this method, a weight advantage as compared to cast iron is achieved, since the core sand is considerably lighter than the cast material. Tie-rod core 3 from FIGS. 2 through 4 is produced from a non-gassing sand in the present example. Alternatively, ceramic bodies, silicon bodies or bodies made of similar materials may also be used as tie-rod core 3 from FIGS. 2 through 4.

Figure 5:
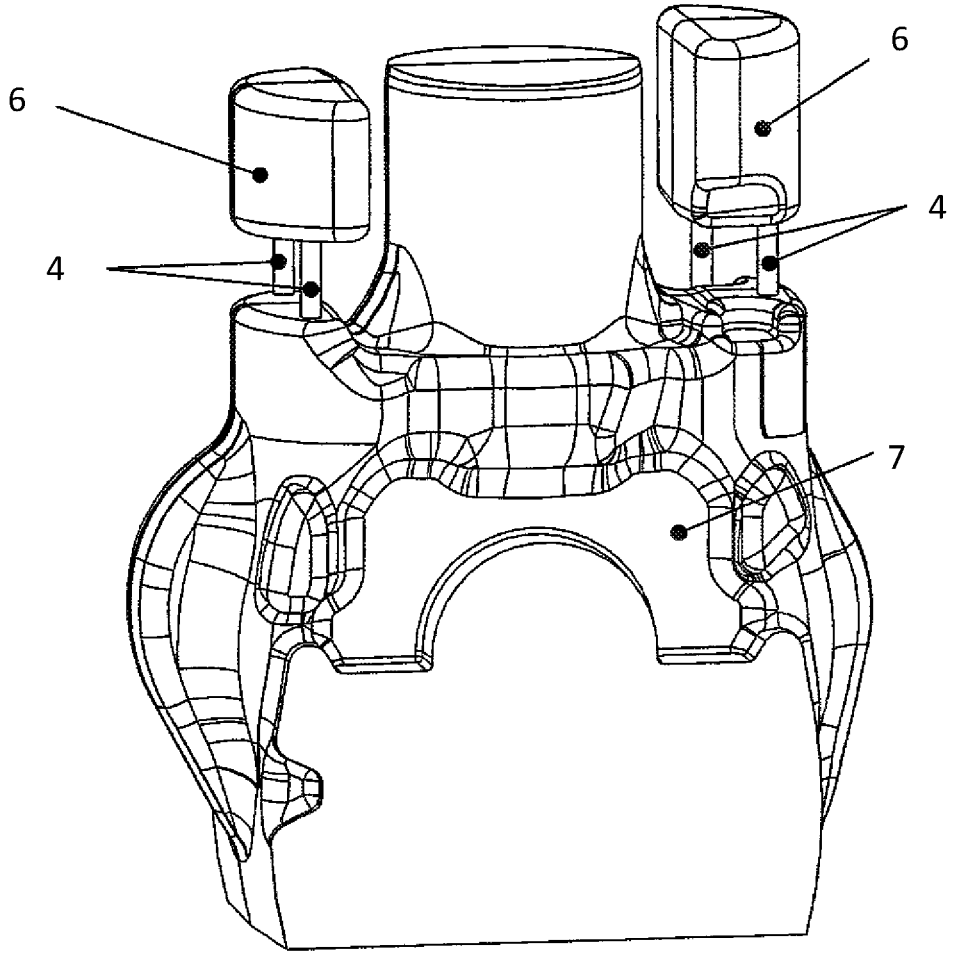
FIG. 5 shows the tie-rod core.

A crankcase core 7 is illustrated in FIG. 5. A sand core 6 enclosed in the cylinder crankcase is connected to crankcase core 7 with the aid of bolt 4, bolts 4 being cast for fastening.

The present disclosure provides a method for generating a cylinder crankcase including a foreign object inclusion for cast reduction and for the improved cleanliness of the generated component. The cast material is in particular removed or pushed from the areas between the tie-rods 2 below the water jacket 1, to avoid dirt input into the component during later engine operation and in that the areas below the water jacket 1 between the tie-rods are designed as a separate tie-rod core 3 (FIG. 2); and bolts 4 used during later installation at the water jacket core 5 are enclosed in the tie-rod core 3, so that the tie-rod core 3 is completely surrounded by cast material in the component following the cast and the bolt 4 has coalesced with the cast. The tie-rod core 3 remains in the generated component and is located in an encapsulated space generated by the cast material.

LIST OF REFERENCE NUMERALS

1 water jacket
2 tie-rod
3 tie-rod core
4 bolt
5 water jacket core
6 sand core
7 crankcase core

What is claimed is:

1. A method for generating a cylinder crankcase including a foreign object inclusion for cast reduction, the method comprising:

providing a tie-rod core;

installing bolts at a water jacket core and enclosing the bolts in the tie-rod core;

performing a casting such that the tie-rod core removes or pushes out a cast material from areas between tie-rods and below the water jacket to avoid dirt input into a component in the cylinder crankcase during later engine operation and in that the areas below the water jacket between the tie-rods, and so that the tie-rod core is completely surrounded by the cast material in the component following the casting and the bolts have coalesced with the cast material, the tie-rod core remaining in the component and being located in an encapsulated space generated by the cast material.

2. The method as recited in claim 1 wherein the tie-rod core is formed of a core sand lighter than the cast material.

3. The method as recited in claim 1 wherein the tie-rod core is formed of a non-gassing sand, ceramic bodies or silicon bodies.

4. The method as recited in claim 1 wherein the providing of the tie-rod core includes providing a plurality of tie-rod cores spaced apart from each other.

5. The method as recited in claim 4 wherein the installing of the bolts at the water jacket core and enclosing the bolts in the tie-rod core includes enclosing two bolts in each of the tie-rod cores.

6. A cylinder crankcase for an internal combustion engine comprising:

a cast material;

a water jacket including a water jacket core and defining tie-rods;

a tie-rod core within the cast material between the tie-rods and below the water jacket; and bolts enclosed in the tie-rod core and extending into the water jacket, the tie-rod core being completely surrounded by the cast material.

7. The cylinder crankcase as recited in claim 6 wherein the tie-rod core is formed of a core sand lighter than the cast material.

8. The cylinder crankcase as recited in claim 6 wherein the tie-rod core is formed of a non-gassing sand, ceramic bodies or silicon bodies.

9. The cylinder crankcase as recited in claim 6 further comprising further tie-rod cores, all of the tie-rod cores being spaced apart from each other.

10. The cylinder crankcase as recited in claim 9 wherein two bolts are enclosed in each tie-rod core.

* * * * *